US005694893A

United States Patent [19]

Chan et al.

[11] Patent Number: 5,694,893

[45] Date of Patent: Dec. 9, 1997

[54] OUTWARD OPENING VALVE SYSTEM FOR AN ENGINE

[75] Inventors: Anthony K. Chan, Peoria; Dennis D. Feucht, Morton; Gregory J. Kaufman, Metamora; Steven F. Meister, Chillicothe, all of Ill.

[73] Assignee: Caterpillar Inc., Peoria, Ill.

[21] Appl. No.: 767,746

[22] Filed: Dec. 17, 1996

Related U.S. Application Data

[63] Continuation-in-part of Ser. No. 635,800, Apr. 22, 1996, Pat. No. 9,615,646.

[51] Int. Cl.[6] ..... F01L 9/02

[52] U.S. Cl. ..... 123/90.12; 123/90.24

[58] Field of Search ..... 123/90.12, 90.13, 123/90.15, 90.24, 79 C, 188.8

[56] References Cited

U.S. PATENT DOCUMENTS

| | | | |
|---|---|---|---|
| 1,049,123 | 12/1912 | Mercer | 123/188.8 |
| 1,129,393 | 2/1915 | Huff | 123/76 |
| 1,405,597 | 2/1922 | Kirby | 123/90.47 |
| 1,491,023 | 4/1924 | Belden | 123/90.27 |
| 1,539,227 | 5/1925 | Wood | 123/65 VB |
| 1,695,011 | 12/1928 | Fornaca | 123/90.49 |
| 1,914,340 | 6/1933 | Holzwarth | 123/41.41 |
| 1,965,517 | 7/1934 | Vitalini | 123/90.12 |
| 2,552,006 | 5/1951 | Gill | 123/65 VC |
| 2,954,017 | 9/1960 | Forstner | 123/90.16 |
| 3,168,083 | 2/1965 | Buchanan | 123/90.24 |
| 3,430,614 | 3/1969 | Meacham | 123/90.24 |
| 3,463,131 | 8/1969 | Dolby | 123/90.25 |
| 3,518,976 | 7/1970 | Thuesen | 123/90.16 |
| 3,926,159 | 12/1975 | Michelson et al. | 123/90.11 |
| 3,978,826 | 9/1976 | Gavrun et al. | 123/90.24 |
| 4,364,341 | 12/1982 | Holtmann | 123/90.17 |
| 4,502,426 | 3/1985 | Skelley | 123/90.15 |
| 4,593,658 | 6/1986 | Moloney | 123/90.12 |
| 4,602,597 | 7/1986 | Rhoads | 123/90.15 |
| 4,723,515 | 2/1988 | Burandt | 123/90.16 |
| 4,930,464 | 6/1990 | Letsche | 123/90.12 |
| 4,977,869 | 12/1990 | Fayard | 123/188.8 |
| 5,373,817 | 12/1994 | Schechter et al. | 123/90.12 |
| 5,448,973 | 9/1995 | Meyer | 123/90.12 |
| 5,522,358 | 6/1996 | Clarke | 123/188.8 |

FOREIGN PATENT DOCUMENTS

| | | |
|---|---|---|
| 2467971 | 5/1981 | France . |
| 512 113 | 1/1955 | Italy . |
| 9418437 | 8/1994 | WIPO . |

*Primary Examiner*—Weilun Lo
*Attorney, Agent, or Firm*—Liell & McNeil

[57] ABSTRACT

An outward opening valve system includes an engine having a fluid cavity in fluid communication with an accumulator chamber by a transfer passage, a hollow piston cylinder in fluid communication with a gas passageway via an opening, and an intensifier bore that opens to the hollow piston cylinder. The opening includes an outward valve seat adjacent the gas passageway. An outward valve member with a valve face is moveable between a closed position in which the valve face is against the valve seat closing the opening and an open position in which the valve face is away from the valve seat. A compression spring is utilized to bias the outward valve member toward its open position. An intensifier piston is positioned in the intensifier bore with one end exposed to fluid pressure in the hollow piston cylinder. A coupling linkage interconnects the intensifier piston to the outward valve member. An accumulator plunger is positioned in the accumulator chamber and moveable between a release position and a storage position, but is biased toward its release position by a compression spring. A control valve member is positioned in the transfer passage and has a first position in which the accumulator chamber is open to the fluid cavity and a second position in which the accumulator chamber is closed to the fluid cavity.

20 Claims, 2 Drawing Sheets

OUTWARD OPENING VALVE SYSTEM FOR AN ENGINE

RELATION TO OTHER PATENT APPLICATION

This application is a continuation-in-part of patent application Ser. No. 08/635,799, filed Apr. 22, 1996, and entitled METHOD AND APPARATUS FOR HOLDING A CYLINDER VALVE CLOSED DURING COMBUSTION, now U.S. Pat. No. 5,615,646.

TECHNICAL FIELD

The present invention relates generally to piston cylinder valve systems for internal combustion engines, and more particularly to an outward opening valve system for an engine.

BACKGROUND ART

In the past, almost all engines utilized inwardly opening valves to permit the exchange of gases with the engine's hollow piston cylinders between each combustion event. The valve member typically includes an enlarged head portion with an annular valve face that is positioned within the hollow piston cylinder, and a stem attached to the enlarged portion that protrudes away from the opening connecting the cylinder to a gas passageway. During combustion, these valve members are held against their seats by the high pressure differential existing across the valve opening. In most cases, these types of valves are pushed open between combustion events by a cam that is driven directly by the engine. While these types of cam driven inwardly opening valves have performed well over many years, the current trend toward electronically controlled valves may render the inward opening valves of the prior art unsuitable.

In the case of diesel engines, the timing of valve opening with the movement of the piston in its cylinder is critical because the piston and valve members must necessarily occupy the same space within the hollow piston cylinder, only at different times. Although valve to piston contact is a possibility with prior art cam driven systems, it rarely occurs because the mechanical interconnection of the various components makes such contact extremely unlikely. In the case of electronically controlled and actuated valve members, piston contact is much more likely because there is no mechanical interconnection. In other words, potentially catastrophic valve to piston contact can occur simply because of an erroneous open command produced by the engine computer due to software errors and/or erroneous sensor inputs to the computer. Thus, the real and perceived danger of valve to piston contact with electronically actuated and control valves has hindered movement in the industry to a camless engine that is completely electronically actuated and controlled.

One method of avoiding the possibility of valve to piston contact is to utilize outwardly opening valves that are actually positioned outside the hollow piston cylinder, and therefore do not have the possibility of valve to piston contact. However, outwardly opening valves have never been successfully implemented into diesel engines on a large scale because of the great difficulty in holding such valve members closed during the high pressures produced by combustion. In those cases where outwardly opening valves have been successfully utilized, the actuation system employed to both hold the valve closed and open the valve at desired times often requires large amounts of energy, which again renders such a system less than desirable.

The present invention is directed to overcoming one or more of the problems as set forth above.

DISCLOSURE OF THE INVENTION

In one embodiment, an outward opening valve system includes an engine having a fluid cavity in fluid communication with an accumulator chamber by a transfer passage, a hollow piston cylinder in fluid communication with a gas passageway via an opening, and an intensifier bore that opens to the hollow piston cylinder. The opening includes an outward valve seat adjacent the gas passageway. An outward valve member with a valve face is moveable between a closed position in which the valve face is against the valve seat closing the opening, and an open position in which the valve face is away from the valve seat. Means are provided for biasing the outward valve member toward its open position. An intensifier piston is positioned in the intensifier bore with one end exposed to fluid pressure within the hollow piston cylinder. A coupling linkage interconnects the intensifier piston and the outward valve member. An accumulator plunger is positioned in the accumulator chamber and moveable between a release position and a storage position. Means are provided for biasing the accumulator plunger toward its release position. Finally, a control valve member is positioned in the transfer passage and has a first position in which the accumulator chamber is open to the fluid cavity, and a second position in which the accumulator chamber is closed to the fluid cavity.

In another embodiment, an outwardly opening valve system includes an engine having a fluid cavity in fluid communication with an accumulator chamber by a transfer passage, a hollow piston cylinder in fluid communication with a gas passageway via an opening, an intensifier bore that opens to the hollow piston cylinder, a drain passage that opens to the accumulator chamber, and a re-supply passage that opens to the fluid cavity. The opening includes an outward valve seat adjacent the gas passageway. An outward valve member with a valve face is moveable between a closed position in which the valve face is against the valve seat closing the opening and an open position in which the valve face is away from the valve seat. An intensifier piston is positioned in the intensifier bore with one end exposed to fluid pressure within the hollow piston cylinder. A coupling linkage interconnects the intensifier piston and the outward valve member. An accumulator plunger is positioned in the accumulator chamber and moveable between a release position and a storage position. A control valve member is positioned in the transfer passage and moveable a distance between a first position in which the fluid cavity is open to the re-supply passage and the accumulator chamber is open to the drain passage, and a second position in which the fluid cavity is closed to the re-supply passage and the accumulator chamber is closed to the drain passage. The fluid cavity opens to the accumulator chamber when the control valve member is moving between the first position and the second position over a portion of the distance.

One object of the present invention is to eliminate the possibility of valve to piston contact during the operation of an engine.

Another object of the present invention is to exploit combustion pressure to hold an outwardly opening valve closed during combustion.

Still another object of the present invention is to support one possible avenue of technology toward the goal of a camless engine.

Another object of the present invention is to provide an outwardly opening valve system for an engine that requires a relatively small amount of energy to actuate.

BEST MODE FOR CARRYING OUT THE INVENTION

Figure 1:
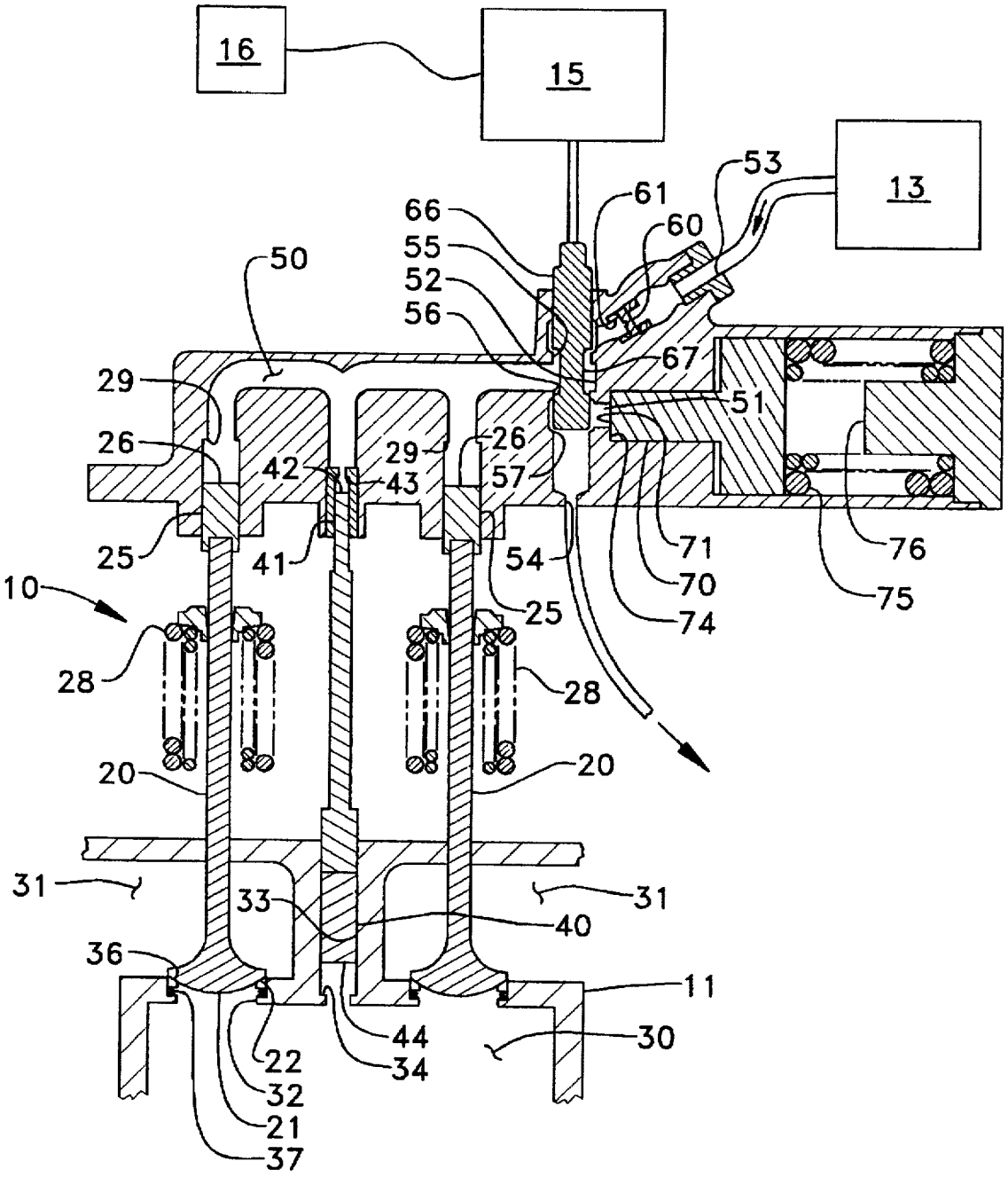
FIG. 1 is a partial sectioned side elevational view of an outwardly opening valve system for an engine according to the present invention in its closed position.
Figure 2:
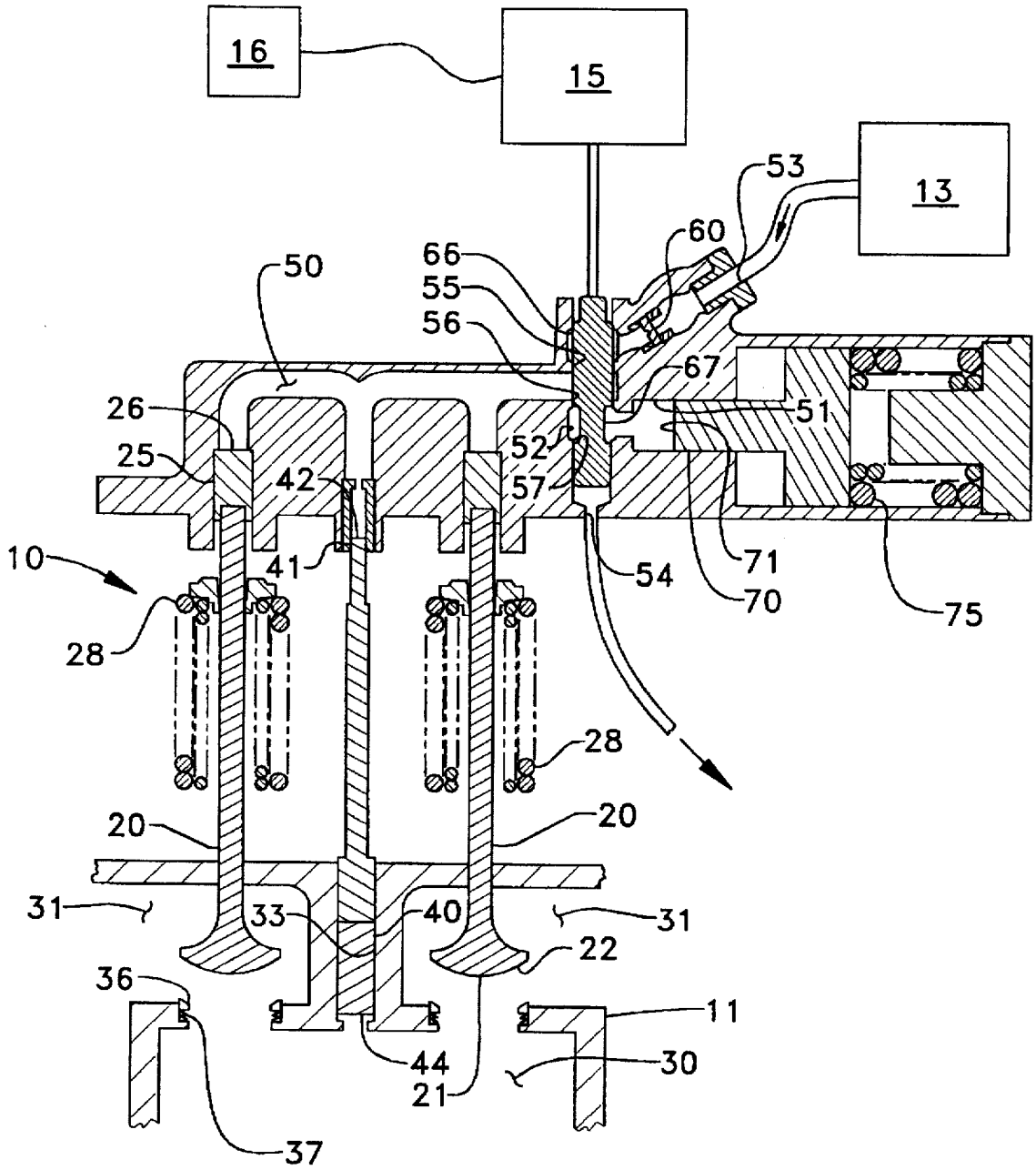
FIG. 2 is a partial sectioned side elevational view of an outwardly opening valve system for an engine in its open position.

Referring now to FIGS. 1 and 2, an outwardly opening valve system 10 includes an engine 11 having a fluid cavity 50 in fluid communication with an accumulator chamber 51 by a transfer passage 52. The engine also includes a hollow piston cylinder 30 in fluid communication with a gas passageway 31 via an opening 32. An intensifier bore 33 opens to hollow piston cylinder 30. A drain passage 54 opens to accumulator chamber 51. Finally, a re-supply passage 53 opens to fluid cavity 50 past a spool control valve member 66. Opening 32 includes an outward valve seat 36 that is adjacent gas passageway 31. An outward valve member 20 includes an enlarged head portion 21 having an annular valve face 22. Outward valve member 20 is moveable between a closed position, as shown in FIG. 1, in which valve face 22 is against valve seat 36 closing opening 32, and an open position, as shown in FIG. 2, in which valve face 22 is away from valve seat 36. An intensifier piston 40 is positioned in intensifier bore 33 with one end 44 exposed to fluid pressure in hollow piston cylinder 30.

An accumulator plunger 70 is positioned in accumulator chamber 51 and moveable between a release position, as shown in FIG. 1, and a storage position, as shown in FIG. 2. A control valve member 66 is positioned in transfer passage 52 and moveable a distance between a first position, as shown in FIG. 1, and a second position, as shown in FIG. 2. When spool control valve member 66 is in its first position, fluid cavity 50 is open to re-supply passage 53 and accumulator chamber 51 is open to drain passage 54. When in its second position, fluid cavity 50 is closed to re-supply passage 53 and accumulator chamber 51 is closed to drain passage 54. When spool control valve member is moving between its first position and its second position, annulus 67 opens fluid cavity 50 to accumulator chamber 51 past valve seat 56. Transfer passage 51 also includes valve seat 57 which controls the opening and closing of drain passage 54, as well as annular valve seat 55 which controls the opening and closing of re-supply passage 53.

Re-supply passage 53 includes a one-way check valve 60 that is biased to a closed position by a compression spring 61. In this way, valve 60 only permits the flow of hydraulic fluid through re-supply passage into fluid cavity 50, but prevents reverse flow. Re-supply passage 53 is connected to a source of high pressure hydraulic fluid 13, such as engine lubricating oil elevated to a relatively high pressure by a high pressure pump, not shown.

A hydraulic coupling linkage interconnects intensifier piston 40 to outward valve member 20. This coupling linkage includes a valve plunger 25 with one end attached to outward valve member 20 and an other end 26 contacting a hydraulic fluid in fluid cavity 50. An intensifier plunger 41 has one end attached to intensifier piston 40 and an other end 42 contacting the hydraulic fluid in fluid cavity 50. Stops 34 and 43 limit the range of movement of the combined intensifier plunger 41 and intensifier piston 40. Likewise, an annular stop 29 limits the range of movement of outward valve member 20 and valve plunger 25.

Compression springs 28 bias outward valve member 20 toward its open position. Compression springs 75 act to bias accumulator plunger 70 toward its release position. Backstop 76 limits the distance that accumulator plunger can travel. Compression springs 75 and 28 are comparable in strength in that if accumulator chamber 51 were left open to fluid cavity 50, accumulator plunger 70 and outward valve member 20 would find an equilibrium position somewhere between that shown in FIGS. 1 and 2.

When the system is in the configuration as shown in FIG. 1, fluid cavity 50 is closed and outward valve member 20 is hydraulically locked in its closed position. The exposed portion of enlarged head 21, end 44 of intensifier piston 40, end 42 of intensifier plunger 41 and end 26 of valve plunger 25 are sized such that increasing pressure in hollow piston cylinder 30 caused by combustion only serves to further hold outward valve member 20 in its closed position. Thus, as with the inwardly opening valves of the prior art, combustion pressure serves to hold the opening 32 closed to avoid pressure loss due to gas leakage during the combustion event. During the combustion event a solenoid 15, which is attached to spool control valve member 66 holds the same in the position shown in FIG. 1.

A computer 16 communicates with and is capable of controlling solenoid 15. Those skilled in the art will appreciate that computer 16 is utilized to provide the precise timing to properly control the movement of spool control valve member 66 during each combustion cycle. After the combustion cycle is complete, solenoid 15 is commanded to move spool control valve member 66 from the first position as shown in FIG. 1 to its second position as shown in FIG. 2. As spool control valve member 66 moves downward, it simultaneously closes valve seat 55 and opens valve seat 56. When valve seat 56 opens, the stored energy in compression springs 28 is released causing valve plunger 25 to move upward displacing hydraulic fluid from fluid cavity 50 into accumulator chamber 51, causing accumulator plunger 71 to retract toward its storage position against the action of compression springs 75. Compression springs 28 and compression springs 75 as well as the masses of the various components and the momentum of the fluid transfer, is such that valve plunger 25 moves all the way to its stop 29 before control valve member 66 completes its movement to its second position which closes valve seat 56.

Before the next combustion event begins, solenoid 15 is commanded to return control valve member 66 from its second position as shown in FIG. 2 to its first position as shown in FIG. 1. When this occurs, annulus 67 again opens accumulator chamber 51 to fluid cavity 50 allowing the energy stored in compression springs 75 to be transferred back to compression springs 28 via a fluid transfer from accumulator chamber 51 to fluid cavity 50. Since some energy loss is inevitable, accumulator plunger 70 will normally be unable to completely return to its release position and outward valve member 20 will be unable to completely return to its closed position before control valve member 66 reaches its first position. During this brief time period before the next combustion event, high pressure fluid enters re-supply passage 53, goes past check valve 60, past valve seat 55 and into fluid cavity 50 completing movement of outward valve member 20 to its closed position. At the same time, any remaining fluid in accumulator chamber 51 is forced out through drain passage 54 by the remaining energy stored in compression springs 75. Thus, a relatively small amount of energy is required to operate the system since a substantial portion of the energy utilized is recovered during each cycle. The only energy utilized is a relatively small amount of hydraulic fluid pumped past check valve 60 during each cycle and the energy required to move spool control valve member 66 between its first position and its second position.

When in operation, a simple harmonic motion is achieved through the passing of energy via hydraulic fluid between compression valve springs 28 and accumulator compression springs 75, with the mass of the valve system oscillating therebetween. The timing of the valve opening and closing events is determined by electronically controlling the system via computer 16, which controls the flow of hydraulic fluid between fluid cavity 50 and accumulator chamber 51.

Industrial Applicability

By utilizing an intensifier piston 40 that is coupled to the outward opening valve member 20 via a coupling linkage as in the present invention, the valves' opening and closing mechanism can be separate from the means by which the valve is held closed during a combustion event. Thus, the present invention allows electronically controlled valve opening and closing mechanisms to be utilized in a manner in which the potential for direct piston to valve contact is eliminated, while at the same time eliminating concerns about leakage past the valve during combustion events. Furthermore, this is accomplished with a minimal use of energy since the majority of the energy necessary to open and close the valve is recovered during each combustion cycle through the simple harmonic motion and energy transfer that occurs between compression springs 28 and accumulator springs 75.

The present invention finds potential application in virtually any internal combustion engine. However, the present invention is especially applicable to diesel engines because the extended compression strokes of diesel type engines raises the possibility of potentially catastrophic contact between the piston and a valve member. The present invention eliminates this possibility, while at the same time exploiting combustion pressure to hold the valves closed during a combustion event, as with the inwardly opening valves of the prior art.

It should be understood that the above example is for illustrative purposes only and is not intended to in any way limit the scope of the present invention. For instance, while the coupling linkage between intensifier piston 40 and outward valve member 20 has been illustrated as a hydraulic linkage, those skilled in the art will appreciate that a rocker arm assembly could be substituted in its place. It should be noted that the invention has been illustrated as a dual valve system for a relatively large diesel engine. When in use, a pair of systems of the type shown in FIG. 1 would be utilized, one for the intake valves and one for the exhaust valves. Nevertheless, the present invention can be sized appropriately for any number of intake or exhaust valves for a particular engine application. Other objects and advantages of the present invention will no doubt occur to those skilled in the art after a close review of the attached drawings, the appended claims and the concepts disclosed in the above specification.

We claim:

1. An outwardly opening valve system for an engine comprising:

an engine having a fluid cavity in fluid communication with an accumulator chamber by a transfer passage, a hollow piston cylinder in fluid communication with a gas passageway via an opening, and an intensifier bore that opens to said hollow piston cylinder;

said opening including an outward valve seat adjacent said gas passageway;

an outward valve member with a valve face, and said valve member being moveable between a closed position in which said valve face is against said valve seat closing said opening and an open position in which said valve face is away from said valve seat;

means for biasing said outward valve member toward said open position;

an intensifier piston positioned in said intensifier bore with one end exposed to fluid pressure within said hollow piston cylinder;

a coupling linkage interconnecting said intensifier piston and said outward valve member;

an accumulator plunger positioned in said accumulator chamber and moveable between a release position and a storage position;

means for biasing said accumulator plunger toward said release position; and a control valve member positioned in said transfer passage and having a first position in which said accumulator chamber is open to said fluid cavity, and a second position in which said accumulator chamber is closed to said fluid cavity.

2. The outwardly opening valve system of claim 1 wherein said coupling linkage includes:

a valve plunger with one end attached to said outward valve member and another end contacting a hydraulic fluid in said fluid cavity;

an intensifier plunger with one end attached to said intensifier piston and an other end contacting said hydraulic fluid in said fluid cavity.

3. The outwardly opening valve system of claim 2 wherein said means for biasing said outward valve member includes a first compression spring.

4. The outwardly opening valve system of claim 3 wherein said means for biasing said accumulator plunger includes a second compression spring.

5. The outwardly opening valve system of claim 2 wherein said control valve member is a spool valve member.

6. The outwardly opening valve system of claim 2 wherein said outward valve member is in said closed position when said accumulator plunger is in said release position; and said outward valve member is in said open position when said accumulator plunger is in said storage position.

7. The outwardly opening valve system of claim 2 wherein said fluid cavity is sized such that movement of said outward valve member from said closed position to said open position hydraulically moves said accumulator plunger from said release position to said storage position, and vice versa, when said control valve member is in said first position.

8. The outwardly opening valve system of claim 2 further comprising:

a re-supply passageway opening to said fluid cavity;

a check valve positioned in said re-supply passage an being operable to prevent back flow of said hydraulic fluid from said fluid cavity into said re-supply passage.

9. The outwardly opening valve system of claim 8 wherein said control valve member blocks said re-supply passage to said fluid cavity when in said first position.

10. The outwardly opening valve system of claim 9 wherein said re-supply passage is connected to a source of hydraulic fluid at a pressure; and said pressure is sufficiently high to hydraulically move said outward valve member toward said closed position against the action of said means for biasing said outward valve member.

11. The outwardly opening valve system of claim 8 wherein said control valve member has a third position in which said re-supply passage is blocked and said transfer passage is blocked;

said re-supply passage is blocked when said control valve member is in said first position; and said re-supply passage is open to said fluid cavity when said control valve member is in said second position.

12. The outwardly opening valve system of claim 2 wherein said engine further includes a drain passage that opens to said accumulator chamber; and said control valve member closes said drain passage when in said second position.

13. The outwardly opening valve system of claim 12 further comprising:

a re-supply passageway opening to said fluid cavity;

a check valve positioned in said re-supply passage an being operable to prevent back flow of said hydraulic fluid from said fluid cavity into said re-supply passage.

14. The outwardly opening valve system of claim 13 further comprising a source of high pressure hydraulic fluid connected to said re-supply passage.

15. The outwardly opening valve system of claim 1 wherein said valve seat is a spring biased floating valve seat.

16. The outwardly opening valve system of claim 1 further comprising a solenoid attached to said control valve member.

17. The outwardly opening valve system of claim 16 further comprising a computer in communication with and capable of controlling said solenoid.

18. The outwardly opening valve system of claim 1 wherein said control valve member moves between said first position and said second position over a time period;

said outward valve member moves between said open position and said closed position within said time period; and said accumulator plunger moves between said release position and said storage position within said time period.

19. An outwardly opening valve system comprising:

an engine having a fluid cavity in fluid communication with an accumulator chamber by a transfer passage, a hollow piston cylinder in fluid communication with a gas passageway via an opening, an intensifier bore that opens to said hollow piston cylinder, a drain passage that opens to said accumulator chamber, and a re-supply passage that opens to said fluid cavity;

said opening including an outward valve seat adjacent said gas passageway;

an outward valve member with a valve face, and said valve member being moveable between a closed position in which said valve face is against said valve seat closing said opening and an open position in which said valve face is away from said valve seat;

an intensifier piston positioned in said intensifier bore with one end exposed to fluid pressure within said hollow piston cylinder;

a coupling linkage interconnecting said intensifier piston and said outward valve member;

an accumulator plunger positioned in said accumulator chamber and moveable between a release position and a storage position;

a control valve member positioned in said transfer passage and moveable a distance between a first position in which said fluid cavity is open to said re-supply passage and said accumulator chamber is open to said drain passage, and a second position in which fluid cavity is closed to said re-supply passage and said accumulator chamber is closed to said drain passage; and said fluid cavity opens to said accumulator chamber when said control valve member is moving between said first position and said second position over a portion of said distance.

20. The outwardly opening valve system of claim 19 wherein said coupling linkage includes:

a valve plunger with one end attached to said outward valve member and another end contacting a hydraulic fluid in said fluid cavity;

an intensifier plunger with one end attached to said intensifier piston and an other end contacting said hydraulic fluid in said fluid cavity; and the system further comprising:

means for biasing said outward valve member toward said open position; and means for biasing said accumulator plunger toward said release position.

* * * * *